US007094133B2

(12) United States Patent
Masunaga et al.

(10) Patent No.: US 7,094,133 B2
(45) Date of Patent: Aug. 22, 2006

(54) RETAINER AND WAFER POLISHING APPARATUS

(75) Inventors: Takayuki Masunaga, Yokohama (JP); Shinobu Oofuchi, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/985,048

(22) Filed: Nov. 10, 2004

(65) Prior Publication Data

US 2006/0099893 A1 May 11, 2006

(51) Int. Cl.
*B24B 29/00* (2006.01)

(52) U.S. Cl. ..... 451/54; 451/56; 451/286; 451/398

(58) Field of Classification Search ..... 451/54, 451/56, 21, 443, 398, 286, 397, 283, 285, 451/288; 427/331, 386; 216/88
See application file for complete search history.

(56) References Cited

U.S. PATENT DOCUMENTS 6,139,428 A * 10/2000 Drill et al. ..... 451/41
6,390,904 B1 * 5/2002 Gleason et al. ..... 451/286
6,899,610 B1 * 5/2005 Cooper et al. ..... 451/397
2004/0123951 A1 * 7/2004 Kramer et al. ..... 156/345.12

FOREIGN PATENT DOCUMENTS

JP 2002-18709 1/2002
KR 2002-0065965 8/2002

OTHER PUBLICATIONS

Korean Patent Office "Notification for Filing Opinion" dated Feb. 8, 2006, issued in counterpart Korean Application No. 10-2004-59473.

* cited by examiner

*Primary Examiner*—Jacob K. Ackun, Jr.
(74) *Attorney, Agent, or Firm*—Finnegan, Henderson, Farabow, Garrett & Dunner, L.L.P.

(57) ABSTRACT

When a wafer is pressed on a rotating polishing pad and its surface is polished, a retainer retains the periphery of the wafer to prevent the wafer from being detached from the polishing pad. The retainer includes a first ring which surrounds the wafer and contacts the polishing pad and a second ring which is provided outside the first ring in the radial direction of the wafer and contacts the polishing pad. The second ring has wear resistance that is higher than that of the first ring.

16 Claims, 5 Drawing Sheets

FIG. 10
PRIOR ART
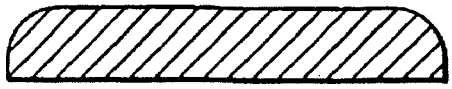
FIG. 11
PRIOR ART
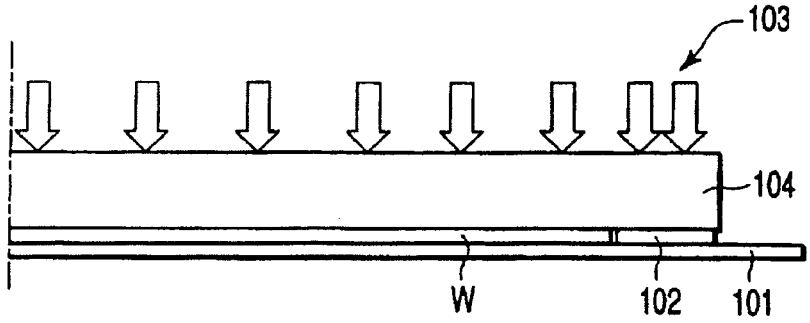
FIG. 12
PRIOR ART
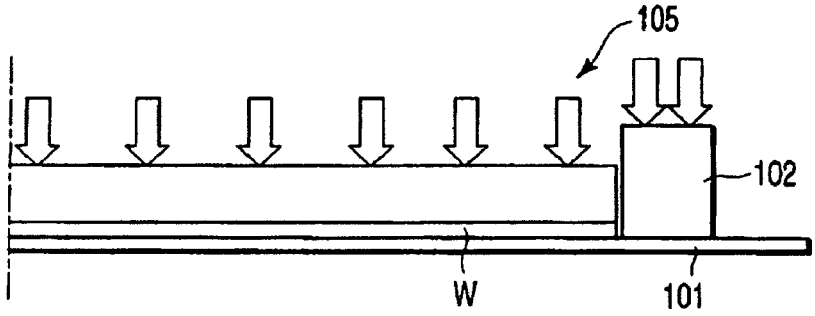
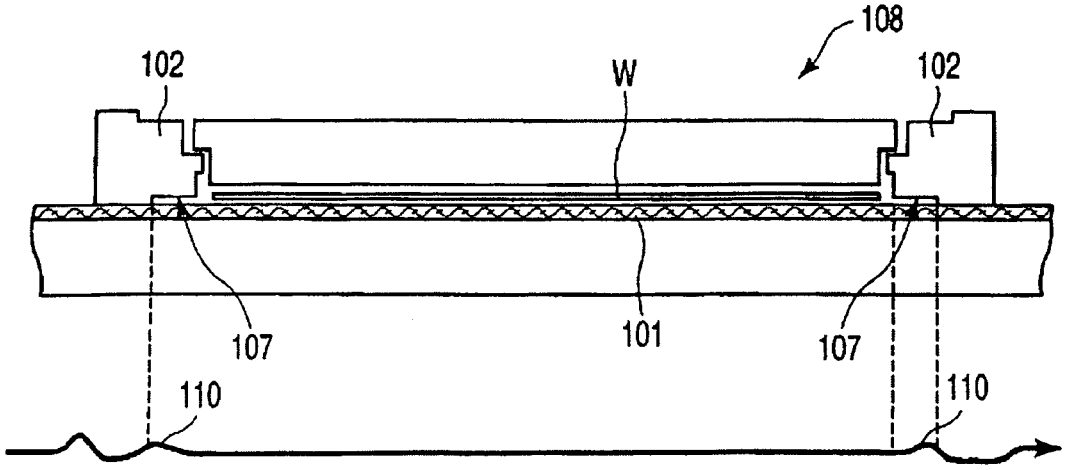
FIG. 13
PRIOR ART

RETAINER AND WAFER POLISHING APPARATUS

BACKGROUND OF THE INVENTION

1. Field of the Invention

The present invention relates to a wafer polishing apparatus for polishing the surface of a wafer and, more particularly, to the structure of a retainer for retaining the periphery of a wafer.

2. Description of the Related Art

A wafer manufacturing process includes a polishing step of mirror-finishing the surface of a wafer. In this polishing step, a wafer polishing apparatus is used to polish the surface of a wafer by pressing the wafer on the surface of a polishing pad that is rotating.

The wafer polishing apparatus has a polishing table that is rotated by a drive shaft. A polishing pad is provided on the top surface of the polishing table, and a wafer retaining head for retaining and rotating a wafer is provided on the top surface of the polishing pad.

The wafer retaining head has an up-and-down driving mechanism and allows the retained wafer to be pressed on the surface of the polishing pad at a desired contact pressure. The surface of the wafer pressed on the polishing pad is polished and mirror-finished by friction with the polishing pad.

A great force is exerted on a wafer under polishing toward the outer radius of the wafer retaining head by friction with the polishing pad that is rotating. A retainer is therefore disposed on the outer region of the underside of the wafer retaining head to retain the periphery of a rotating wafer, thereby preventing the wafer from jumping out of the underside of the wafer retaining head.

The polishing pad is usually formed of viscoelastic materials. The viscoelastic materials have a viscous region whose stress is proportionate to the speed of deformation. As shown in FIG. 8, therefore, a great pressure is exerted on the periphery of a wafer W due to the compression and deformation of the polishing pad 101 when a (non-compressed) portion of the polishing pad 101, which is located ahead of the wafer W in its moving direction, goes under the wafer W. This causes a problem of a so-called outer sag in which the periphery of the wafer W is polished more than the central part thereof, as illustrated in FIG. 10.

In order to resolve the above problem, recently, the polishing pad 101 that is located ahead of the wafer W in its moving direction has been compressed in advance by pressing the retainer 102 on the polishing pad 101, as shown in FIG. 9. When the polishing pad 101 goes under the wafer W, no great pressure is exerted on the periphery of the wafer W; therefore, an outer sag can be prevented from occurring on the wafer W.

FIG. 11 shows the structure of a wafer retaining head 103 corresponding to the above-described wafer retaining head.

In the wafer retaining head 103, the wafer W and retainer 102 are brought into contact with the polishing pad 101 by applying the load of one press platen 104 to the wafer W and retainer 102. This structure can simplify the structure of the wafer polishing apparatus, whereas it causes the following problem. Due to the friction between the polishing pad 101 and the underside of the retainer 102, no desired load can be applied to the polishing pad 101 as time elapses.

When the load of the retainer 102 on the polishing pad 101 lowers, the polishing pad 101 on the underside of the retainer 102 increases in thickness, thereby causing a difference in thickness between the polishing pad 101 on the underside of the retainer 102 and the polishing pad 101 on the underside of the wafer W. The stress due to the compression and deformation of the polishing pad 101 is therefore likely to cause an outer sag on the periphery of the wafer W.

In order to resolve the above problem, a wafer retaining head 105 is used to control the load applied to the wafer W and the load applied to the retainer 102 independently of each other. The structure of the wafer retaining head 105 is shown in FIG. 12.

With the structure shown in FIG. 12, the polishing pad 101 can always be pressed by the same load even though the retainer 102 is worn out by friction between the retainer 102 and the polishing pad 101. Since, however, the retainer 102 plays a role in retaining the periphery of the wafer W as described above, the retainer 102 needs to be disposed close to the outer circumference of the wafer W. Since the retainer 102 presses the polishing pad 101, a prominence 110 arising from the polishing pad 101 is likely to interfere with the periphery of the wafer W and cause an outer sag.

In order to resolve the above problem, another wafer retaining head 108 is developed in which a groove 107 is formed at the inner radius of the retainer 102 to escape the prominence 110 and a portion of the retainer 102 which presses the polishing pad 101 and another portion thereof which retains the wafer W are separated from each other (disclosed in, e.g., Jpn. Pat. Appln. KOKAI Publication No. 2002-18709). The structure of the wafer retaining head 108 is shown in FIG. 13.

Since the wafer retaining head 108 can control the load applied to the wafer W and the load applied to the retainer 102 independently of each other, it can always press the polishing pad 101 at a constant force. Moreover, the prominence 110 that is formed at the inner radius of the retainer 102 does not interfere with the periphery of the wafer W and thus no outer sag occurs.

In the wafer retaining head 108, however, the contact portion of the retainer 102 with the polishing pad 101 is gradually worn out by friction. Consequently, the groove 107 is gradually shallowed and finally vanished.

As a result, the entire underside of the retainer 102 presses the polishing pad 101, and the prominence 110 that is formed at the inner radius of the retainer 102 causes an outer sag on the periphery of the wafer W.

BRIEF SUMMARY OF THE INVENTION

The present invention has been developed in consideration of the above situation and its object is to provide a long-life retainer capable of preventing an outer sag from occurring on the periphery of a wafer and a wafer polishing apparatus including the retainer.

In order to attain the above object, a retainer and a wafer polishing apparatus according to the present invention are configured as follows:

(1) A retainer opposed to a rotating polishing pad to retain a periphery of a wafer, the retainer comprising an annular first member which surrounds the wafer, and an annular second member which is provided outside the first member in a radial direction, the second member having wear resistance that is higher than that of the first member.

(2) In the retainer described in above paragraph (1), the first member has a groove on a side that is opposed to the polishing pad.

(3) In the retainer described in above paragraph (1), the second annular member includes a plurality of annular members which are so arranged that the wear resistance gradually increases toward an outer radius of each of the annular members.

(4) A retainer that surrounds a wafer to retain a periphery of the wafer, wherein the retainer is made of a functionally gradient material whose wear resistance gradually increases toward an outer radius of the wafer.

(5) A retainer opposed to a rotating polishing pad to retain a periphery of a wafer, the retainer comprising an annular first member which surrounds the wafer, an annular second member which is provided outside the first member in a radial direction, the second member protruding toward the polishing pad more than the first member, and adjusting member which adjusts an amount of protrusion of the second member relative to the first member.

(6) In the retainer described in above paragraph (5), the first member is fixed to a mounting member, and the adjusting member is an adjustment plate provided detachably between the mounting member and the first member.

(7) In the retainer described in above paragraph (5), the second member is fixed to a mounting member, and the adjusting member is an adjustment plate provided detachably between the mounting member and the second member.

(8) A wafer polishing apparatus comprising:

a polishing table having a polishing pad and rotated, a carrier which polishes a surface of a wafer that is pressed on the polishing pad, and a retainer provided outside the carrier to retain a periphery of the wafer and contact the polishing pad, the retainer including an annular first member which surrounds the wafer and an annular second member which is provided outside the first member in a radial direction, the second member having wear resistance that is higher than that of the first member.

According to the present invention, an outer sag can be prevented from occurring on the periphery of a wafer and the lifetime of a retainer can be lengthened.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIGS. 3A to 3C are schematic diagrams each showing the shape of a retainer according to the first embodiment and the distribution of pressure applied to the retainer in a step of forming a groove in the retainer, in which FIG. 3A shows the initial state of the retainer, FIG. 3B shows the state of the retainer under break-in polishing, and FIG. 3C shows the state of the retainer after break-in polishing.

FIG. 10 is a sectional view illustrating the thickness of a wafer that is polished using a prior art retainer.

FIG. 11 is a schematic view of the structure of a prior art wafer retaining head that applies a load to a wafer and a retainer through a single press platen.

FIG. 12 is a schematic view of the structure of a prior art wafer retaining head that controls a load applied to a wafer and a load applied to a retainer independently of each other.

FIG. 13 is a schematic view of the structure of a prior art wafer retaining head having a groove to escape a prominence under a retainer.

DETAILED DESCRIPTION OF THE INVENTION

Figure 1:
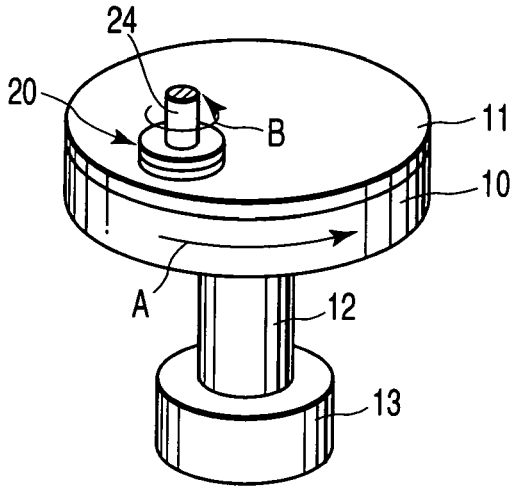
FIG. 1 is a perspective view of the structure of a wafer polishing apparatus according to a first embodiment of the present invention.

FIG. 1 is a perspective view of the structure of a wafer polishing apparatus according to a first embodiment of the present invention.

The wafer polishing apparatus includes a polishing table 10 and a wafer retaining head 20. The polishing table 10 is shaped like a disk and a polishing pad 11 is stuck on the top surface of the polishing table 10. The materials of the polishing pad 11 are selected appropriately according to those of a wafer W.

A drive shaft 12 is fixed to the underside of the polishing table 10. An output shaft (not shown) of a motor 13 is coupled to the drive shaft 12. The motor 13 is driven to rotate the polishing table 10 in the direction of arrow A.

The top surface of the polishing pad 11 stuck on the polishing table 10 is supplied with a polishing solution through a supply nozzle (not shown). As the polishing solution, an alkaline solution containing colloidal silica is used.

The wafer retaining head 20 can be moved up and down by an up-and-down unit (not shown). The wafer W, which is to be polished, is detachably retained onto the underside of the wafer retaining head 20. The up-and-down unit lowers the wafer retaining head 20 to press the retained wafer W on the polishing pad 11.

A control unit (not shown) is connected to the up-and-down unit. The control unit controls a load applied to the wafer retaining head 20 and adjusts the contact pressure between the wafer W and the polishing pad 11 at a desired value.

It is only one wafer retaining head 20 that is shown in FIG. 1. The first embodiment of the present invention is not limited to this. For example, a plurality of wafer retaining heads can be arranged at regular intervals around the drive shaft 12.

Figure 2:
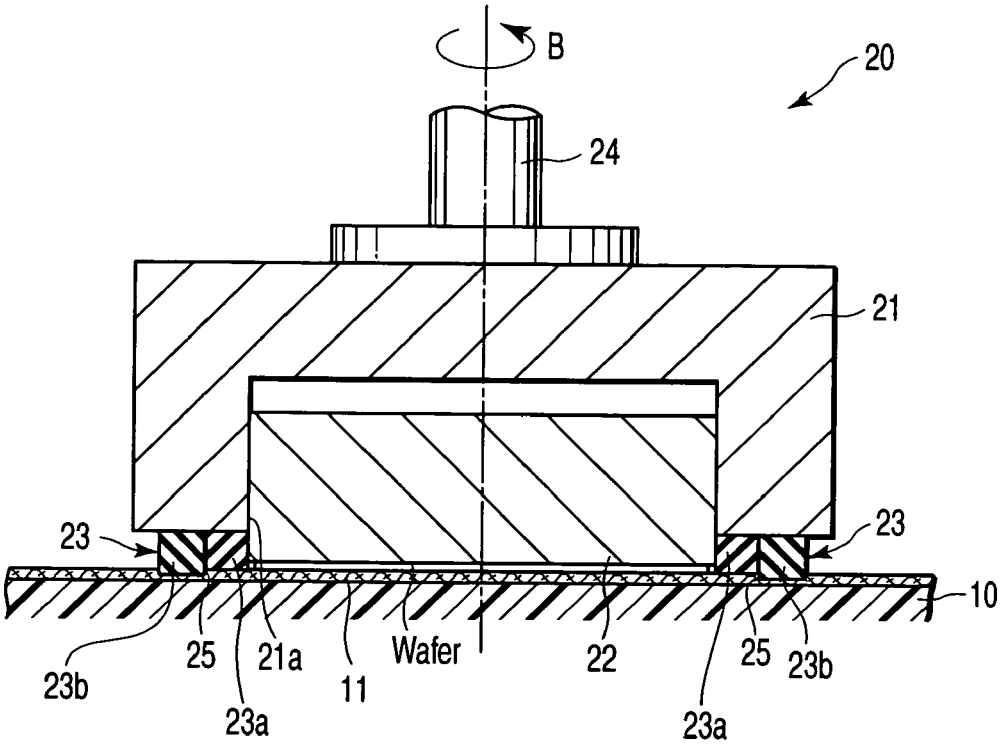
FIG. 2 is a sectional view of the structure of a wafer retaining head according to the first embodiment.

FIG. 2 is a sectional view of the structure of the wafer retaining head 20.

The wafer retaining head 20 includes a main unit 21, a carrier 22 and a retainer 23.

The main unit 21 is a closed-end housing whose opening 21*a* is directed downward, and a rotating shaft 24 is fixed on the top surface of the main unit 21. A motor (not shown) is connected to the rotating shaft 24 and driven to rotate the main unit 21 in the direction of arrow B.

The carrier 22 is shaped almost like a column and fixed inside the main unit 21 such that their axes are aligned with each other. The lower end of the carrier 22 protrudes downward from the opening 21*a* of the main unit 21, and the wafer W, which is to be polished, is retained on the underside of the carrier 22. The motor is driven to rotate the wafer W in the direction of arrow B along with the carrier 22.

The retainer 23 includes annular first rings 23*a* (first members) arranged on the outer circumference of the wafer W and annular second rings 23*b* (second members) arranged outside the first rings 23*a*. These first and second rings 23*a* and 23*b* are fixed on the lower end face of the main unit 21 such that the axes of the rings 23*a* and 23*b* are aligned with that of the main unit 21.

In the first embodiment, the first and second rings 23*a* and 23*b* are formed of annular members. The first embodiment is not limited to this, but a plurality of members can be combined into a single annular ring in its entirety.

The first rings 23*a* surround the wafer W to retain the periphery of the wafer W under polishing such that the wafer W does not jump out of the underside of the carrier 22. The second rings 23*b* press the polishing pad 11 on the outer radius of the wafer W under polishing.

The first rings 23*a* are made of low wear resistant materials such as a polycarbonate resin. The second rings 23*b* are made of high wear resistant materials such as an MC nylon resin, polyimide (VESPEL: trade name), PET, PPS, and a polyacetal resin (DURACON and DELRIN: trade names).

The lower ends of the second rings 23*b* protrude toward the polishing pad 11 more than the first rings 23*a*. Thus, an annular groove 25 is formed in the underside of the retainer 23 to escape a prominence of the polishing pad 11 into the inner radius thereof.

The groove 25 is formed by break-in polishing described later and varied with the materials of the first and second rings 23*a* and 23*b*, those of the polishing pad 11, the rotation speed of the wafer retaining head 20, that of the polishing table 10, and the like.

A step of forming the groove 25 in the underside of the retainer 23 by the break-in polishing will now be described with reference to FIGS. 3A to 3C.

Figure 3C:
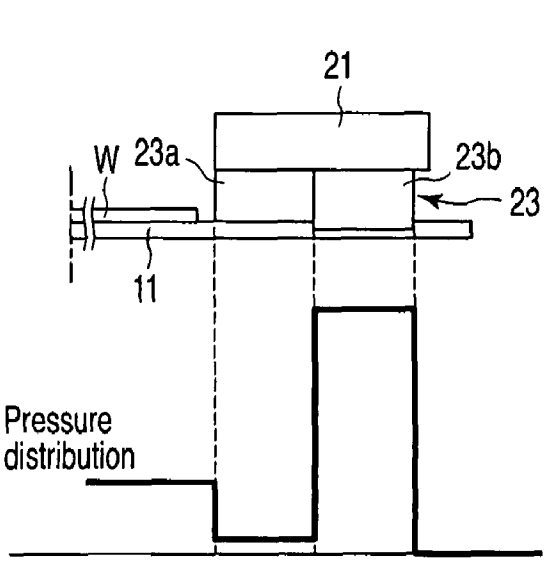
Figure 3B:
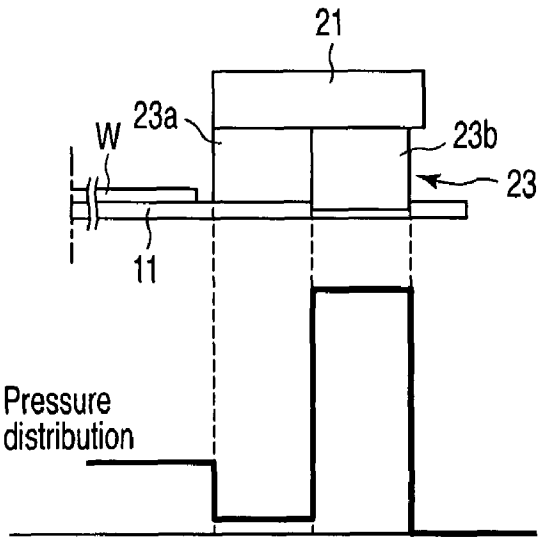
Figure 3A:
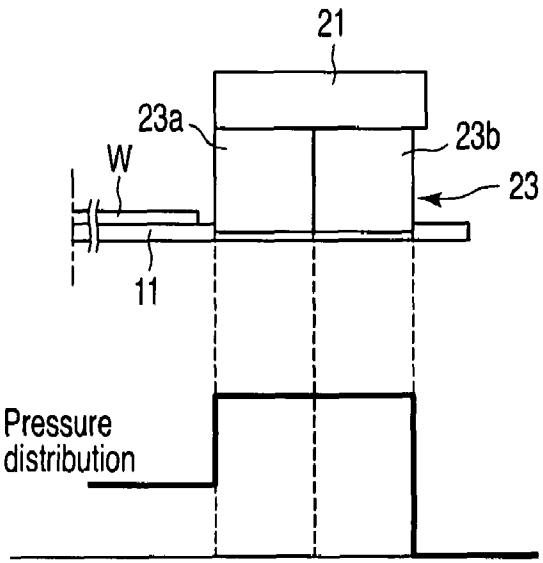

FIGS. 3A to 3C are schematic diagrams each showing the shape of the retainer 23 and the distribution of pressure applied to the retainer 23 in the step of forming the groove 25 in the underside of the retainer 23.

Referring first to A1 of FIG. 3A, the retainer 23 with no step is attached to the main unit 21. Then, the up-and-down unit (not shown) is driven to press the wafer retaining head 20 on the polishing pad 11 at a given load. The contact pressures exerted on the first and second rings 23*a* and 23*b* are substantially equal to each other as shown in A2 of FIG. 3A.

Referring next to B1 of FIG. 3B, both the wafer retaining head 20 and the polishing table 10 are driven under the same conditions as those for polishing the wafer W. Thus, the underside of the retainer 23 is polished by friction with the polishing pad 11 to form a step between the first and second rings 23*a* and 23*b* that differ in wear resistance.

Since the above step is gradually enlarged as the retainer 23 is polished further, the contact pressures exerted on the first and second rings 23*a* and 23*b* vary. If the wear-out speeds of the first and second rings 23*a* and 23*b* become equal to each other, the wafer retaining head 20 and polishing table 10 are stopped to complete the break-in polishing.

After the break-in polishing is completed, the above-described groove 25 is formed in the underside of the retainer 23. There is a given difference between the contact pressures exerted on the first and second rings 23*a* and 23*b*, as shows in B2 of FIG. 3B. When such a difference is caused, a balance between the wear resistance of the first ring 23*a* and that of the second ring 23*b* is achieved and accordingly the wear-out speeds thereof become almost equal to each other.

There now follows an explanation of an operation of polishing a wafer using the wafer polishing apparatus described above.

When the above break-in polishing is completed, the wafer retaining head 20 is lifted and a wafer W to be polished is fed under the head 20. Then, the wafer retaining head 20 is lowered, and the control unit presses the retainer 23 on the polishing pad 11 at a given load. The value of the load is set in such a manner that the thickness of the polishing pad 11 becomes substantially equal to that of the polishing pad 11 that is provided under the wafer W under polishing.

After that, the wafer retaining head 20 and polishing table 10 are driven to polish the retained wafer W by the polishing pad 11. Then, the second ring 23*b* of the retainer 23 compresses the polishing pad 11, which is located ahead of the wafer W in its moving direction, to substantially the same thickness as that of the polishing pad 11 provided under the wafer W. No outer sag therefore occurs.

Since the first ring 23*a* is provided between the wafer W and the second ring 23*b* that presses the polishing pad 11, the wafer W and the second ring 23*b* can be separated from each other by the distance corresponding to the thickness of the first annular ring 23*a* in its radial direction. Consequently, a prominence caused in the inner radius of the second ring 23*b* by pressing the polishing pad 11 by the second ring 23*b* can prevent the periphery of the wafer W from being overpolished.

While the wafer W is being polished, the underside of the second ring 23*b* contacts the polishing pad 11 as shown in C1 of FIG. 3C; therefore, the second ring 23*b* is gradually worn out. During the polishing, however, a prominence in the groove 25 of the retainer 23 also wears out the first annular ring 23*a* from first to last.

The first and second rings 23*a* and 23*b* are worn out at substantially the same speed. At the time of completion of the break-in polishing, therefore, the above difference is maintained between the contact pressures exerted on the first and second rings 23*a* and 23*b*, as shown in C2 of FIG. 3C. Accordingly, the depth of the groove 25 formed in the underside of the retainer 23 is maintained during the polishing of the wafer W. Therefore, the above advantage can always be obtained.

Since the depth of the groove 25 is maintained even though the wear of the retainer 23 advances as described above, the above advantage can be maintained to the end. Consequently, the lifetime of the retainer 23 can dramatically be lengthened by increasing the dimension of the retainer 23 in its up-and-down direction. Moreover, the break-in polishing allows the retainer 23 to have the optimum shape according to the polishing conditions, and different variations need not be prepared.

Figure 4:
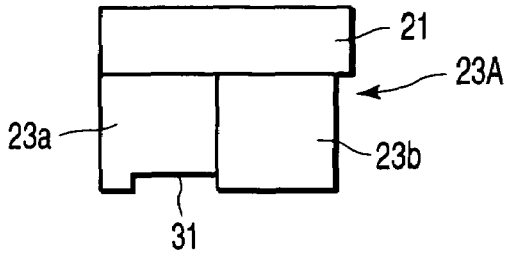
FIG. 4 is a sectional view showing a first modification to the retainer according to the first embodiment.

FIG. 4 is a sectional view of a first modification to the retainer according to the first embodiment of the present invention.

A retainer 23A according to the first modification has a groove 31 that is formed in the underside of the first annular ring 23*a* in its circumferential direction. Therefore, the area of the contact between the first ring 23*a* and the polishing pad 11 (not shown in FIG. 4) reduces, and time required for break-in polishing can be shortened.

Figure 5:
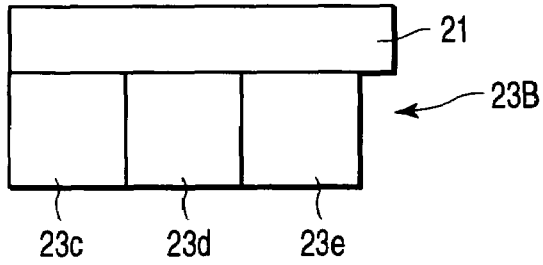
FIG. 5 is a sectional view showing a second modification to the retainer according to the first embodiment.

FIG. 5 is a sectional view of a second modification to the retainer according to the first embodiment of the present invention.

A retainer 23B according to the second modification includes a plurality of rings (three rings 23*c* to 23*e* in this modification) which are so arranged that their wear resistance increases gradually from the inner radius (left side in FIG. 5) to the outer radius. With this arrangement, too, substantially the same advantage as that of the first embodiment can be obtained.

Figure 6:
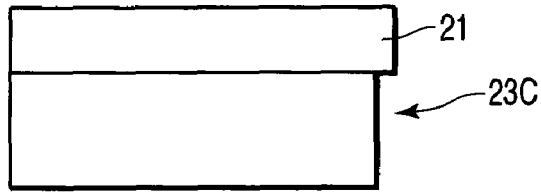
FIG. 6 is a sectional view showing a third modification to the retainer according to the first embodiment.

FIG. 6 is a sectional view of a third modification to the retainer according to the first embodiment of the present invention.

A retainer 23C according to the third modification is made of a so-called functionally gradient material that gradually increases in wear resistance from the inner radius to the outer radius. With this arrangement, too, substantially the same advantage as that of the first embodiment can be obtained.

A second embodiment of the present invention will now be described with reference to FIG. 7. In the second embodiment, the same components as those of the first embodiment are indicated by the same reference numerals and their descriptions are omitted.

Figure 7:
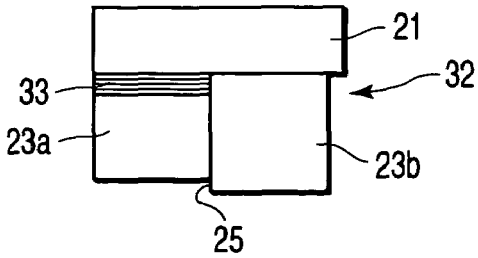
FIG. 7 is a sectional view of the structure of a retainer according to a second embodiment of the present invention.
Figure 8:
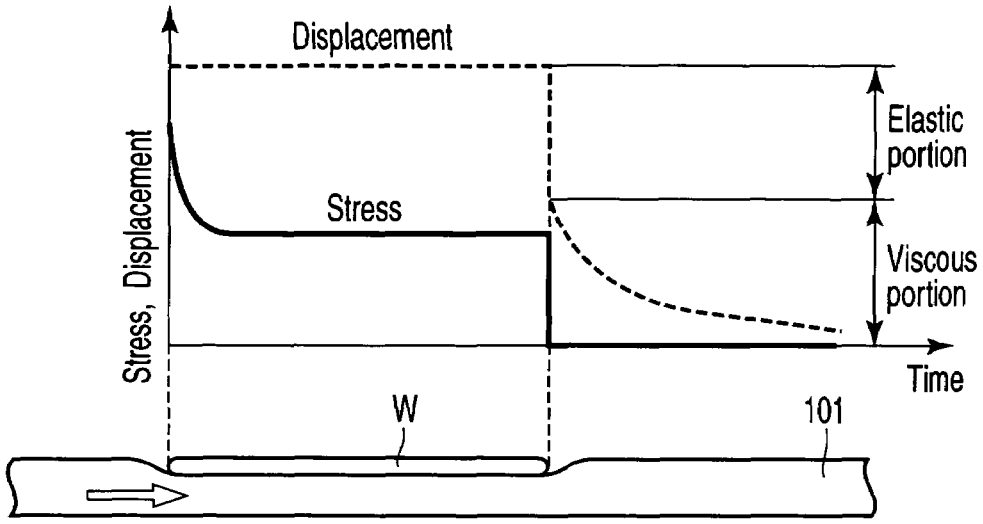
FIG. 8 is an illustration of a mechanism to cause an outer sag in a wafer polishing apparatus whose retainer does not contact a polishing pad.
Figure 9:
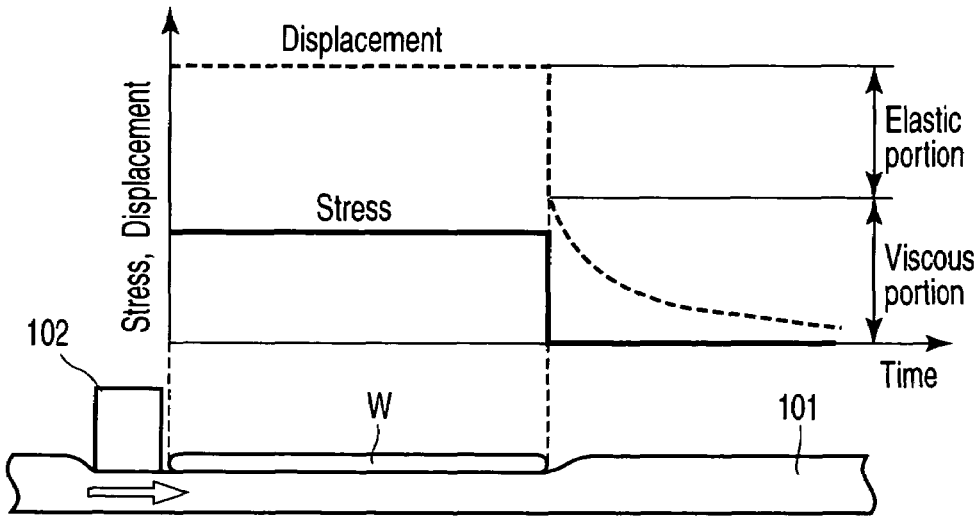
FIG. 9 is an illustration of a mechanism to reduce an outer sag in a wafer polishing apparatus whose retainer contacts a polishing pad.

FIG. 7 is a sectional view of the structure of a retainer 32 according to the second embodiment of the present invention.

The retainer 32 includes a plurality of shims (adjustment plates) 33. The shims 33 are arranged between the main unit 21 and the first annular ring 23*a* to adjust a distance between them.

The first ring 23*a* is formed in advance thinner than the second ring 23*b*. A groove 25 is formed in the underside of the retainer 32 in accordance with a difference in thickness between the first and second rings 23*a* and 23*b*.

The depth of the groove 25 can be adjusted by inserting and extracting the shims 33 and determined such that no outer sag occurs on the periphery of a wafer W while the wafer W is being polished. Thus, the groove 25 can be formed in the underside of the retainer 32 to a desired depth without any break-in polishing. It is thus possible to prevent an outer sag from occurring on the periphery of the wafer W. Furthermore, when the groove 25 is shallowed by polishing the wafer W, its depth can be adjusted to an appropriate one only by extracting the shims 33. Thus, the lifetime of the retainer 23 can be lengthened dramatically.

In the second embodiment, the shims 33 arranged between the main unit 21 and the first ring 23*a* are extracted as the wear of the second ring 23*b* advances. The second embodiment is not limited to this, but the shims 33 can be inserted between the main unit 21 and the second ring 23*b*. In this case, too, the groove 25 can be formed in the underside of the retainer 23*b* to a desired depth to prevent an outer sag from occurring on the periphery of the wafer W.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A retainer opposed to a rotating polishing pad to retain a periphery of a wafer, the retainer comprising:

an annular first member to surround the wafer and come into contact with the rotating polishing pad; and an annular second member which is provided outside the annular first member in a radial direction and to come into contact with the rotating polishing pad, the annular second member having a wear resistance that is higher than that of the annular first member, and including a surface facing the rotating polishing pad which is flat from an inner edge to an outer edge of the annular second member.

2. The retainer according to claim 1, wherein the annular second member includes a plurality of annular members which are so arranged that the wear resistance gradually increases toward an outer radius of each of the annular members.

3. The retainer according to claim 1, wherein the annular second member protrudes toward the rotating polishing pad more than the annular first member such that a thickness of the rotating polishing pad is compressed.

4. The retainer according to claim 3, wherein the annular first and second members are fixed to a mounting member.

5. The retainer according to claim 4, wherein the annular first and second members apply pressure to the rotating polishing pad from the mounting member.

6. A wafer polishing apparatus, comprising:

a polishing table having a polishing pad, the table being rotatable;

a carrier to press a wafer on the polishing pad; and a retainer which is provided outside the carrier in a radial direction, to retain a periphery of the wafer, the retainer including an annular first member to surround the wafer and come into contact with the polishing pad, and an annular second member which is provided outside the annular first member in the radial direction and to come into contact with the polishing pad, the annular second member having a wear resistance that is higher than that of the annular first member, and including a surface facing the polishing pad which is flat from an inner edge to an outer edge of the annular second member.

7. The wafer polishing apparatus according to claim 6, wherein the annular second member protrudes toward the polishing pad more than the annular first member such that a thickness of the polishing pad is compressed.

8. The wafer polishing apparatus according to claim 6, wherein the annular second member includes a plurality of annular members which are so arranged that the wear resistance gradually increases toward an outer radius of each of the annular members.

9. The wafer polishing apparatus according to claim 6, wherein a mounting member is fixed to a side of the annular first and second members opposite to a side which faces the polishing pad.

10. The wafer polishing apparatus according to claim 9, wherein the annular first and second members apply pressure to the polishing pad from the mounting member.

11. A wafer polishing apparatus, comprising:

a polishing table having a polishing pad, the table being rotatable;

a carrier to press a wafer on the polishing pad;

a retainer which is provided outside the carrier in a radial direction and to retain a periphery of the wafer; and a mounting member which is fixed to a side of the annular first and second members opposite to a side which faces the polishing pad, wherein the retainer includes an annular first member to surround the wafer and come into contact with the polishing pad; an annular second member which is provided outside the annular first member in the radial direction, to come into contact with the polishing pad, and which protrudes toward the polishing pad more than the annular first member, the annular second member having a wear resistance that is higher than that of the annular first member; and an adjusting member which is detachably provided between the annular first member and the mounting member; and the adjusting member includes at least one adjustment plate, and an amount of protrusion of the annular second member relative to the annular first member is adjusted by a number of adjustment plates.

12. A wafer polishing apparatus, comprising:

a polishing table having a polishing pad, the table being rotatable;

a carrier to press a wafer on the polishing pad to polish a surface of the wafer;

a retainer which is provided outside the carrier in a radial direction, to retain a periphery of the wafer; and a mounting member which is fixed to a side of the annular first and second members opposite to a side which faces the polishing pad, wherein the retainer includes an annular first member to surround the wafer and come into contact with the polishing pad; an annular second member which is provided outside the annular first member in the radial direction, to come into contact with the polishing pad, and which protrudes toward the polishing pad more than the annular first member, the annular second member having a wear resistance that is higher than that of the annular first member; and an adjusting member which is detachably provided between the annular second member and the mounting member; and the adjusting member includes at least one adjustment plate, and an amount of protrusion of the annular second member relative to the annular first member is adjusted by a number of adjustment plates.

13. A wafer polishing method, comprising:

rotating a polishing table on which a polishing pad is placed;

supplying a polishing solution onto the polishing pad;

pressing a wafer retaining head on the polishing pad and rotating the wafer retaining head, the wafer retaining head including an annular first member, an annular second member which has a wear resistance that is higher than that of the annular first member and is provided outside the annular first member in a radial direction, and a carrier which holds a wafer; and after forming a difference in level between the annular first and second members by polishing them by friction with the polishing pad, polishing the wafer by causing the carrier to hold the wafer to press the wafer onto the rotating polishing pad.

14. A wafer polishing apparatus, comprising:

a polishing table having a polishing pad, the table being rotatable;

a carrier to press a wafer on the polishing pad; and a retainer which is provided outside the carrier in a radial direction, to retain a periphery of the wafer, the retainer including an annular first member to surround the wafer and come into contact with the polishing pad, and an annular second member which is provided outside the annular first member in the radial direction and to come into contact with the polishing pad, the annular second member having a wear resistance that is higher than that of the annular first member, the annular second member including a plurality of annular members which are so arranged that the wear resistance gradually increases toward an outer radius of each of the annular members.

15. A retainer arranged between a rotating polishing pad and a mounting member opposite to the rotating polishing pad to retain a periphery of a wafer, the retainer comprising:

an annular first member to surround the wafer and come into contact with the rotating polishing pad;

an annular second member, which is provided outside the annular first member in a radial direction and to come into contact with the rotating polishing pad, the annular second member having a wear resistance that is higher than that of the annular first member, and protruding toward the rotating polishing pad more than the annular first member; and an adjusting member which is detachably provided between the mounting member and the annular first member to adjust an amount of protrusion of the annular second member relative to the annular first member, and which includes at least one adjustment plate to adjust the amount of protrusion of the annular second member relative to the annular first member.

16. A retainer arranged between a rotating polishing pad and a mounting member opposite to the rotating polishing pad to retain a periphery of a wafer, the retainer comprising:

an annular first member to surround the wafer and come into contact with the rotating polishing pad;

an annular second member, which is provided outside the annular first member in a radial direction and to come into contact with the rotating polishing pad, the annular second member having a wear resistance that is higher than that of the annular first member, and protruding toward the rotating polishing pad more than the annular first member; and an adjusting member which is detachably provided between the mounting member and the annular second member to adjust an amount of protrusion of the annular second member relative to the annular first member, and which includes at least one adjustment plate to adjust the amount of protrusion of the annular second member relative to the annular first member.

* * * * *